US006158973A

United States Patent [19]

Maliszewski

[11] Patent Number: 6,158,973

[45] Date of Patent: Dec. 12, 2000

[54] MULTI-STAGE MANUAL HYDRAULIC PUMP

[75] Inventor: John L. Maliszewski, Sierra Madre, Calif.

[73] Assignee: Trench Plate Rental Co., Inc., Downey, Calif.

[21] Appl. No.: 09/536,227

[22] Filed: Mar. 27, 2000

Related U.S. Application Data

[63] Continuation-in-part of application No. 09/048,964, Mar. 26, 1998, Pat. No. 6,079,956.

[51] Int. Cl.[7] ..... F04B 3/00

[52] U.S. Cl. ..... 417/252; 217/244

[58] Field of Search ..... 417/251, 252, 417/244.5, 62, 216

[56] References Cited

U.S. PATENT DOCUMENTS 3,628,567 12/1971 Bender et al. .
3,747,473 7/1973 Bach et al. .
3,787,147 1/1974 McClocklin et al. .
3,896,620 7/1975 Flory .
3,908,701 9/1975 Dawawala .
4,278,574 7/1981 Vehara et al. .
4,287,813 9/1981 Chatterjea et al. .
4,850,828 7/1989 Yonezawa .
5,207,726 5/1993 Rathweg .
5,575,627 11/1996 Vairin et al. .

*Primary Examiner*—Thomas N. Moulis
*Attorney, Agent, or Firm*—Sanford Astor

[57] ABSTRACT

A multi-stage manual hydraulic pump comprising a plurality of cylinders in tandem. A block holds each cylinder assembly. One or more cylinders are the high volume stage, one or more cylinders are the medium volume stage and the final cylinders are the low volume, high pressure stage. The pump utilizes check valves built into flow tubes that control the direction of fluid. A variable hydraulic piston and cylinder assembly in each high volume block and each medium volume block automatically turns off the vacuum and flow of fluid to each cylinder at a designated pressure. At the point of highest pressure only the smallest cylinder or cylinders are pumping fluid, where the effort expended is significantly reduced.

10 Claims, 6 Drawing Sheets

MULTI-STAGE MANUAL HYDRAULIC PUMP

This is a continuation-in-part of my application Ser. No. 09/048,964 filed Mar. 26, 1998 now U.S. Pat. No. 6,079,956.

BACKGROUND OF THE INVENTION

Manual hydraulic pumps are used in many applications in the field where electrical or other power operated pumps are not practical or economical. One such usage is in the installation of shoring which is the support structure which holds the sides of trenches during construction. The support structure consists of vertical support rails connected together by horizontal cylinders into which fluid, usually water mixed with a soluble oil or other lubricating fluid, is pumped until a desired pressure is reached, to press the vertical rails against the sides of the trench. A series of these support rail structures may be placed along the length of the trench. Each rail support structure must be individually filled with fluid and brought to a pressure to properly press against the sides of the trench to hold it in place and prevent its collapse.

This filling of the horizontal cylinders to the proper pressure is now most often done by a single cylinder manual pump submerged in a container of fluid. A quick connect coupling attaches a hose from the output of the pump to the horizontal cylinder. The pump handle is then pumped to bring the fluid. from the container into the horizontal cylinder. Until the horizontal cylinder is filled with fluid the manual pumping is quite easy. However, when the vertical rails make contact with the trench walls, the manual pumping becomes very difficult. A pressure of from 700 up to about 6000 psi, or higher, may be required, depending upon the nature of the soil, to properly put the shoring in place. It may be very difficult, for one individual to pump the fluid to the pressure required. A need exists for a pump which allows an individual operator to easily fill the fluid in the shoring to the required pressure using a small manual pump which fits into the container of fluid which is to be pumped into the shoring structure.

SUMMARY OF THE INVENTION

This invention comprises an improvement to the multi-stage manual hydraulic pump described in my parent application referenced above. It comprises a plurality of cylinders, pistons, and blocks in tandem. A block holds each cylinder assembly. One or more cylinders comprise the high volume stage, one or more cylinders comprise the medium volume stage and one or more cylinders comprise the low volume, high pressure stage. The pump may comprise as few as two stages or as many as is required to reach the desired pressure. The pump utilizes check valves built into flow tubes that control the direction of fluid. A pressure adjustable hydraulic device operated by air, fluid or a mixture thereof, in each higher volume block, automatically turns off the vacuum and flow of fluid to each higher volume cylinder at a designated pressure of pounds per square inch (psi). At the point of highest pressure only the smallest cylinder or cylinders are pumping fluid, where the effort expended is significantly reduced and the operator may effortlessly pump the amount of fluid required to reach the desired pressure in a very short span of time. The uniqueness of the pump of this invention lies in the ease and quickness in which the pump reaches its designated pressure (psi) and required volume of fluid. Using a pressure adjustable hydraulic device in each higher volume block to automatically turn off the vacuum and flow of fluid to each higher volume cylinder at a designated, but adjustable psi, allows each cylinder to switch from pumping fluid to pumping air. The hydraulic device is contolled by air, fluid or a mixture thereof, with an air and/or fluid intake valve, which allows adjustment of the resistance of the device, to change the psi at which each higher volume cylinder is disabled. The pressure can be adjusted, with each job if necessary, to minimize the work performed by the operator and the time it takes to reach optimum pressure. The highest volume cylinder assembly reaches its designated low pressure and automatically turns off first, the succeeding lower volume cylinders continue to pump fluid.

In turn, the next highest volume cylinders automatically turn off when the desired next higher pressure is reached. Thus, at the point of highest pressure, only the highest pressure, smallest volume cylinder or cylinders are pumping fluid. Because the diameter of the high pressure cylinders is relatively small, the effort expended is reduced significantly. As the pressure increases, the pump becomes increasingly easier to operate. Thus, the operation of the pump of this invention at high pressure is the opposite of what is found in existing manual pumps.

OBJECTS OF THE INVENTION

Accordingly, several objects and advantages of the invention are as follows:

It is an object of the present invention to provide a manual hydraulic pump which allows an individual to easily pump fluid to a high pressure.

Another object of the invention is to provide a simple and small manual hydraulic pump in which a single operator can pump fluid into shoring to a preselected high pressure.

Yet another object of the invention is to provide a simple, small and inexpensive manual hydraulic pump which fits into a container of liquid used to hold shoring in place in construction trenches.

Yet another object of the invention is to provide a simple, small and inexpensive multi-stage manual hydraulic pump which is adjustable as to the psi at which each higher volume cylinder is disabled.

DETAILED DESCRIPTION OF THE INVENTION

Figure 1:
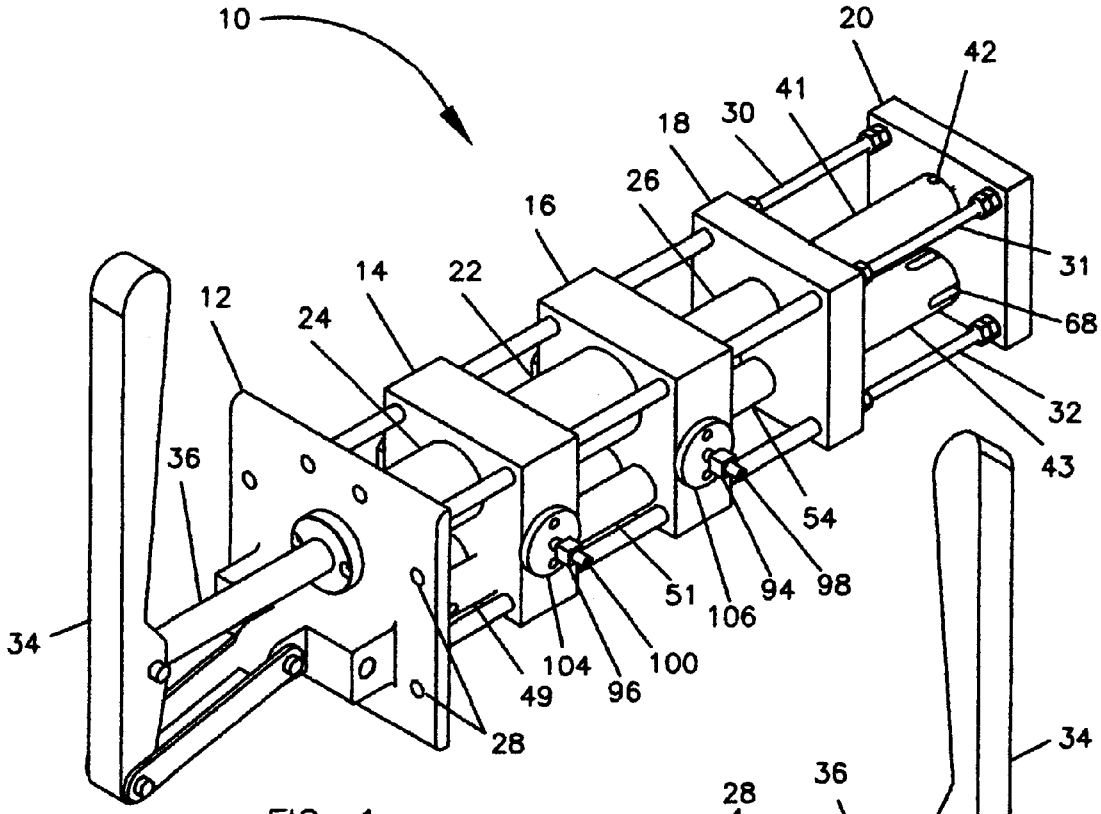
FIG. 1 is a perspective view of the pump of this invention.
Figure 2:
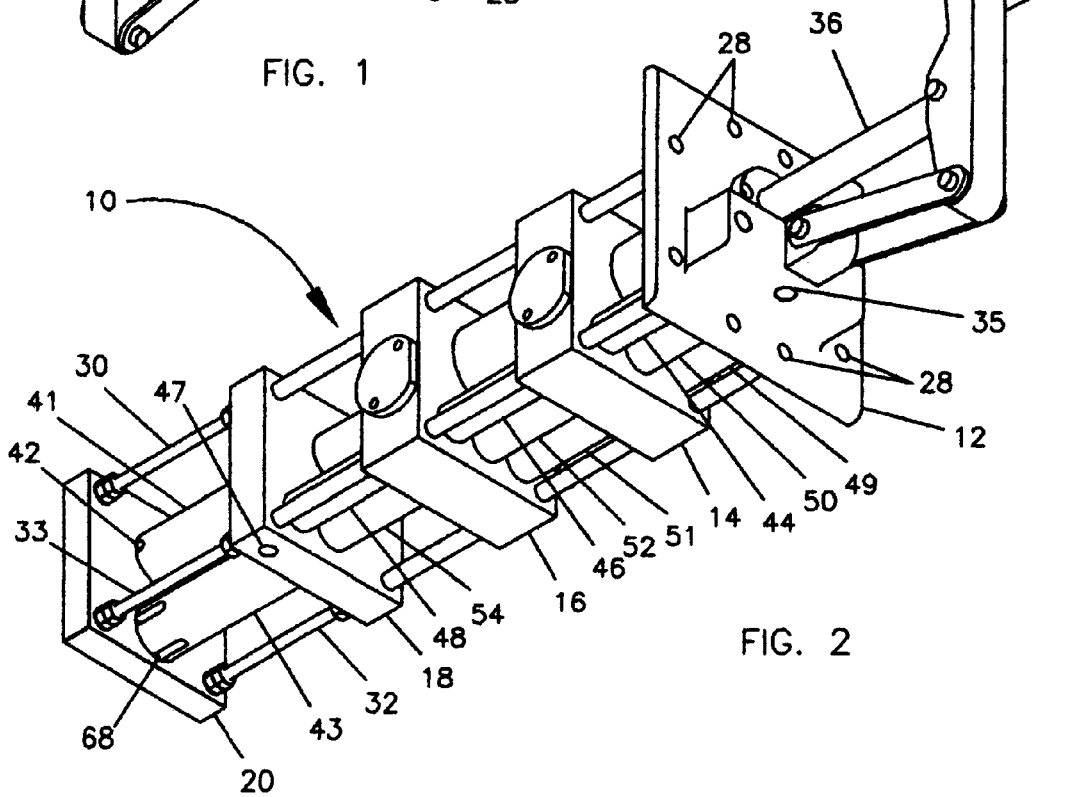
FIG. 2 is a perspective view of the pump of this invention, taken from the opposite side.
Figure 3:
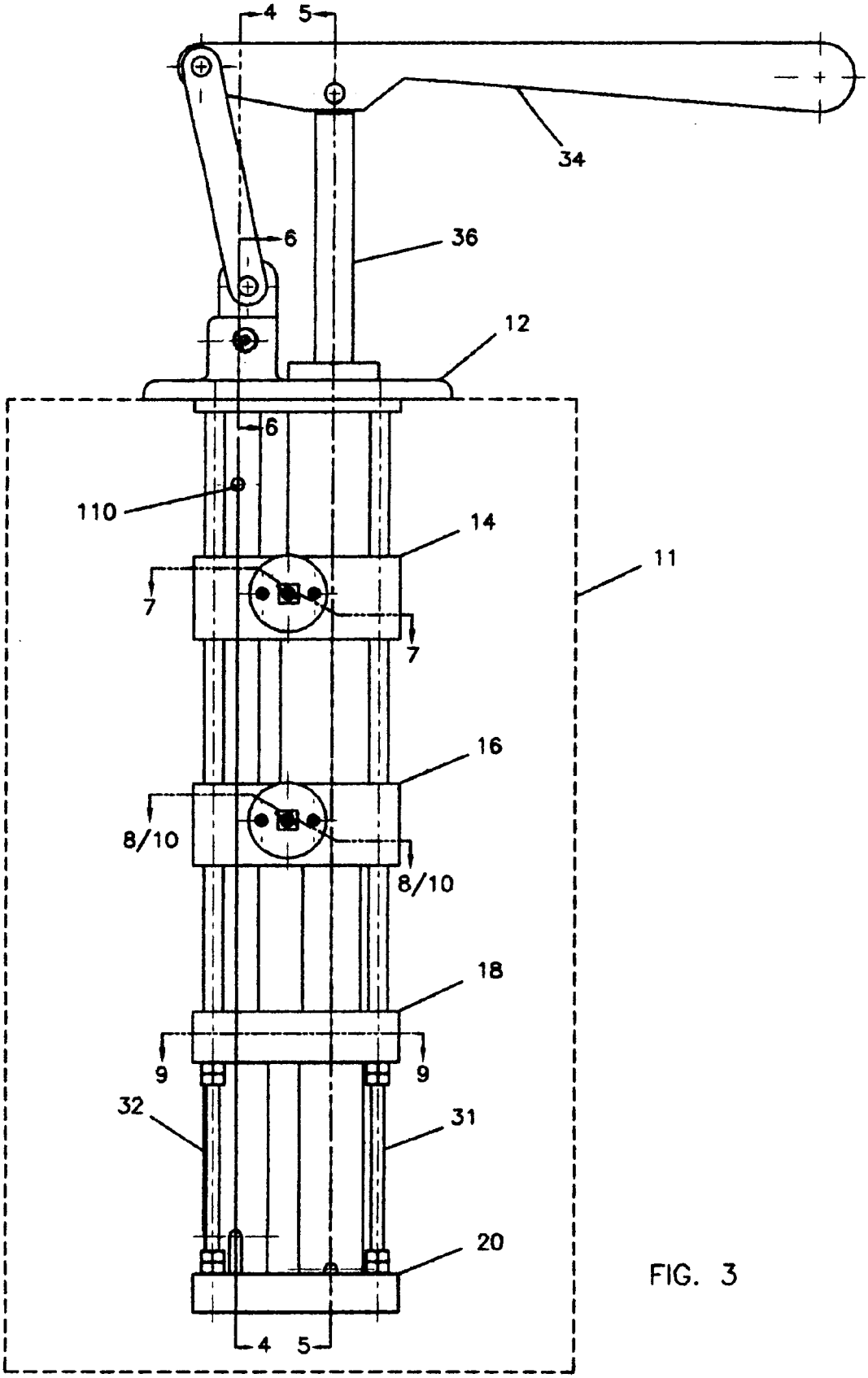
FIG. 3 is a side view.
Figure 4:
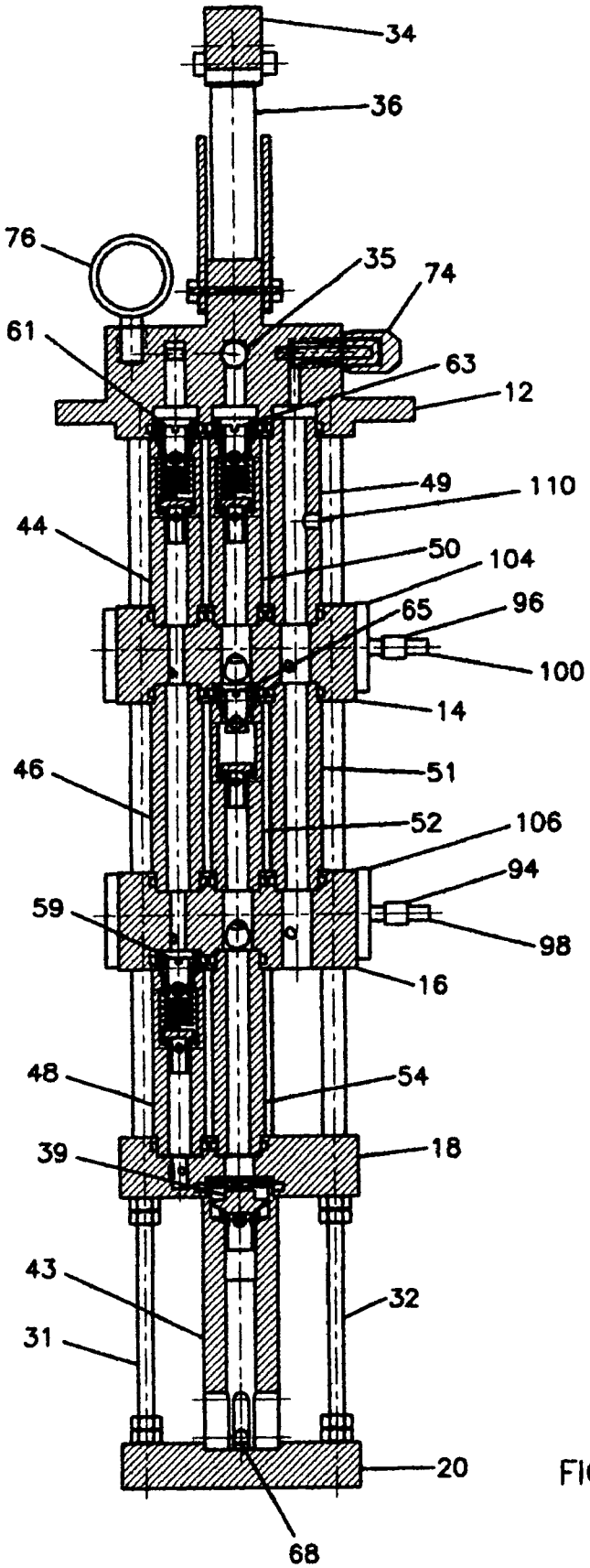
FIG. 4 is a cross-section taken on lines 4—4 of FIG. 3.
Figure 5:
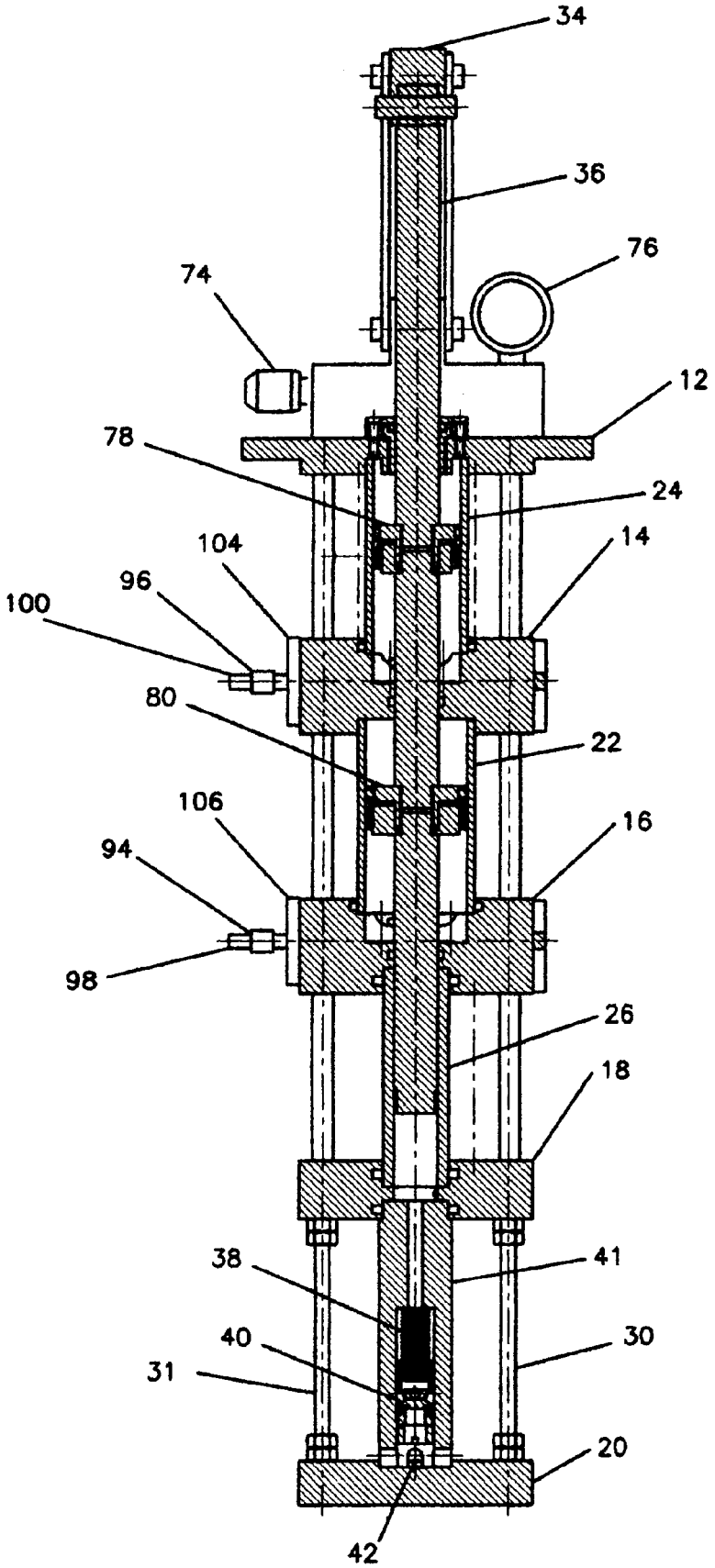
FIG. 5 is a cross-section taken on lines 5—5 of FIG. 3.
Figure 6:
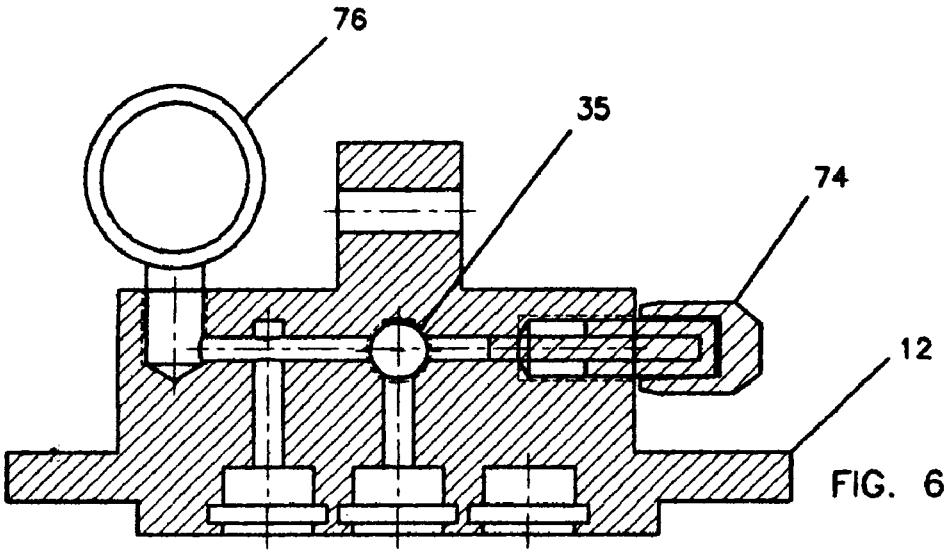
FIG. 6 is a cross-section taken on lines 6—6 of FIG. 4.
Figure 7:
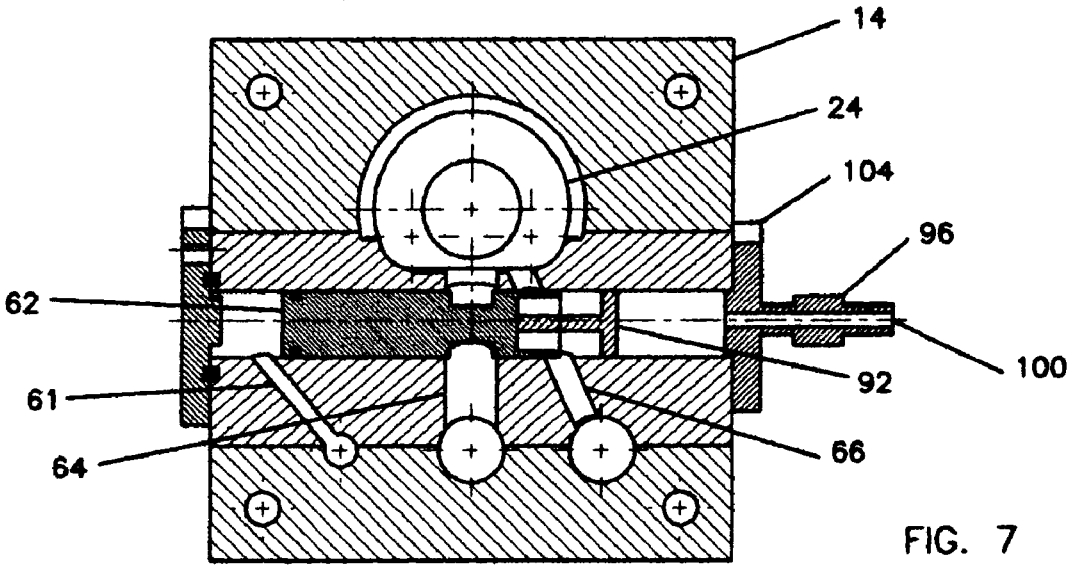
FIG. 7 is a cross-section taken on lines 7—7 of FIG. 3.
Figure 8:
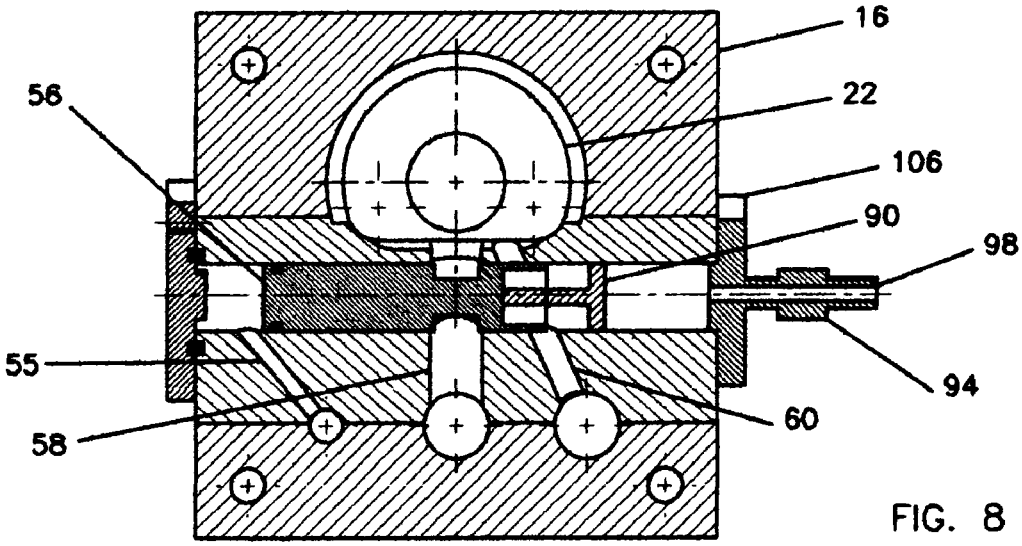
FIG. 8 is a cross-section taken on lines 8—8 of FIG. 3.

Referring now to the drawings there is shown the multi-stage pump 10 of this invention placed in a vented hydraulic fluid container 11. The standard fluid container in use today in the shoring industry, holds about 5 to 7 gallons of fluid. The pump, as shown in this embodiment, comprises four blocks, upper block 12, second stage block 14, first stage block 16, third stage block 18, plus base 20. The pump as shown has three stages but could have from two to as many stages as are required to reach the desired volume and pressure. Blocks 12, 14, 16, 18, and base 20 are held together by a plurality of long bolts 30, 31, 32 and 33 which run the entire length of the pump. Spacers may be used between each block to maintain separation distances.

The pump also comprises three cyliders, the first stage or high volume cylinder 22, the second stage or medium volume cylinder 24, and the high pressure, low volume cylinder 26.

As explained in my parent application, the pump, for best operation, is bolted, by a plurality of bolts, see bolt holes 28, to the top of container 11 and container 11 is filled with a fluid such as water containing hydraulic oil, or other fluid, submerging the pump partially in the fluid. A hydraulic hose is attached, at one end to output port 35 of the pump and at the opposite end to the working shore. The description of the pump will be made with reference to its use in expanding and pressurizing shoring, although the pump could obviously be used for other purposes which require a fluid to be pumped to a high pressure.

When handle 34 is lifted (up-stroke) piston rod 36 is pulled upward, creating a vacuum in the system, exerting a compression force on spring 38 of check valve 40 in intake port 42 located in high pressure intake tube 41, opening check valve 40, allowing fluid to fill high pressure cylinder 26.

Also, on the up-stroke of piston rod 36, which has piston head 78 in cylinder 24 and piston head 80 in cylinder 22, fluid similarly also enters via intake port 68, through check valve 39, which may optionally have a spring, to tubes 54, 52, and 50 and through ports 58 and 64 into cylinders 22 and 24. When the up-stroke of piston rod 36 reaches its highest point, all of the cylinders 22, 24 and 26 are then filled with fluid, as well as tubes 50, 52 and 54 which are also filled with fluid.

On the down-stroke, fluid passes into blocks 14 and 16 through ports 55 and 61 and against pistons 56 and 62. Also on the down-stroke, fluid is pushed from cylinders 22 and 24 back through ports 58 and 64, and through check valves 63 and 65, up tubes 52 and 50 into block 12 and out output port 35. Also, on the down stroke, fluid is pushed from cylinder 26 through communication line 45 in block 18, through port 108, and through check valves 59 and 61, up tubes 48, 46, and 44 into block 12 and out output port 35.

Check valves 59, 61, 63, and 65 prevent fluid from passing back down the tubes and cylinders. Check valves 39 and 40 similarly prevent fluid from passing back through ports 42 and 68.

In the first stage of the manual pumping process all three cylinders 22, 24 and 26 are pumping high volumes of fluid into the shore to expand it as fast as possible, with the least amount of strokes. At this time the horizontal tubing of the shore is expanding quickly to meet the walls of the trench, without any resistance. Once the shore reaches the walls of the trench, the pressure inside of the pump cylinders begins to build up.

Figure 10:
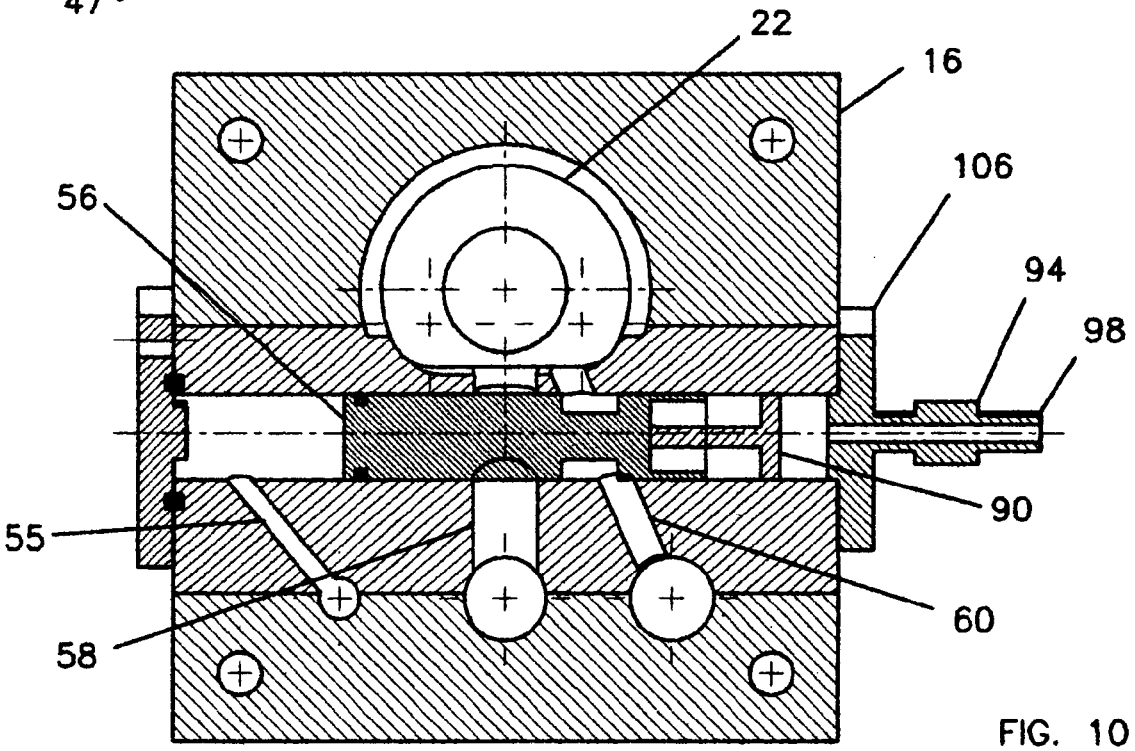
FIG. 10 is a cross-section taken on lines 10—10 of FIG. 3, after piston displacement.

The improvement in the pump in this disclosure is that, when the fluid pressure reaches a preset level, such as 300 psi, as shown in FIG. 10, the first stage pressure control piston 56 located inside of block 16 displaces against adjustable gas and/or fluid controlled piston 90 to close input port 58 preventing all fluid from entering into high volume cylinder 22 and opens exhaust pressure release port 60 to exhaust the fluid into exhaust tubes 51 and 49, and out exhaust port 110, thus disabling high volume cylinder 22. Exhaust port 60 will remain open until the pressure falls below the predetermined fluid pressure. After all fluid has been exhausted through exhaust tube 51, only air will be pumped into and out of cylinder 22 on succeeding strokes. Exhaust port 110 may be located anywhere along the line of tubes 49 and 51.

With the first stage complete and cylinder 22 disabled, cylinders 24 and 26 continue to pump fluid. As the pump handle continues to be actuated, cylinders 24 and 26 continue to increase the system pressure until the fluid pressure reaches another level, such as 1,200 psi. When that pressure is reached, similarly to the process shown in FIG. 10, second stage pressure release piston 62 in block 14 is displaced against gas or fluid controlled piston 92 to close input port 64 preventing all fluid from entering into medium volume cylinder 24 and opens exhaust pressure release port 66 to exhaust the fluid into exhaust tube 51 and 49 and out exhaust port 110, thus disabling medium volume cylinder 24. This completes the second stage.

Optionally, pistons 90 and 92 can be replaced by a sealing device, such as an O-ring on pistons 56 and 62, sealing the gas and/or fluid on the gas and/or fluid side of pistons 56 and 62, preventing the gas and/or fluid from exiting exhaust ports 60 and 66.

The third and final stage comprises low volume, high pressure cylinder 26 continuing to pump fluid as the operator continues to pump handle 34, increasing the pressure of the system from 1,200 psi up to the required final pressure desired, which can be as high as 6000 psi, or even higher.

The difference in volume of the three stages of the pump are dependent on the exact design of the pump, however, in the embodiment shown, the high volume cylinder 22 is from about 5 cubic inches to about 7 cubic inches, the medium volume cylinder 24 from about 1 cubic inch to about 2 cubic inches and the high pressure cylinder 26 from about 0.5 cubic inches to about 1 cubic inch. The volume stated is measured by the total volume of the cylinder less the volume taken up by piston 36 located in cylinders 22 and 24 only.

Figure 9:
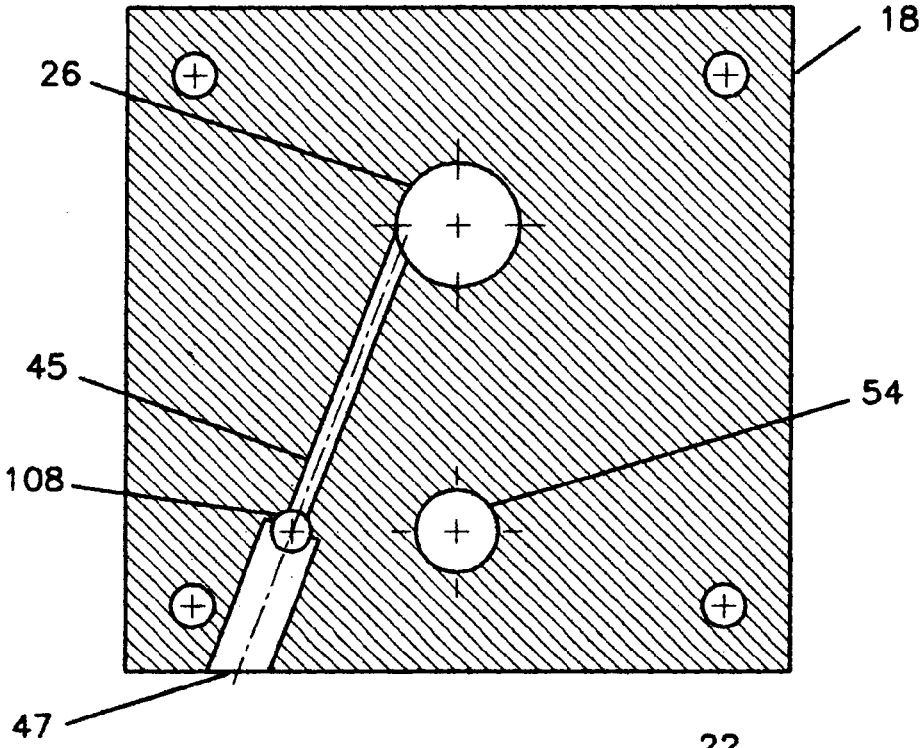
FIG. 9 is a cross-section taken on lines 9—9 of FIG. 3.

Referring to FIG. 9 there is shown block 18 with high pressure cylinder 26, port 108 connected to tube 48 and communication line 45 to pass fluid from high pressure cylinder 26 through communication line 45 up tubes 48, 46, and 44 and out output port 35. Passageway 47 is needed only to machine communication line 45 and passageway 47 is plugged, once communicaion line 45 has been machined.

Input ports 42 and 68 are shown in the vertical position rather than the horizontal position shown in my parent application, however they could be in the horizontal position. All input ports may contain filters to filter out unwanted impurities that might negatively affect the operation of the pump. In the alternative, a filter could be placed around the entire outside perimeter of the pump, from block 18 down to base 20.

Gas and/or fluid input control valves 94 and 96, fitted through caps 104 and 106 are filled through lines 98 and 100, with air and/or fluid, to the pressure desired. By introducing or releasing air and/or fluid, the pressure at which each of the larger volume cylinders is disabled is adjustable within a wide range. Optionally, control valves 94 and 96 may be placed on the top of the higher volume blocks, rather than on the side as shown, which would reduce the width of the pump, providing greater clearance.

Once the shore has reached the desired pressure, the pump can be removed, so that it can be used elsewhere, by releasing the fitting on the shore, which has a check valve to hold the fluid pressure in the shore.

When it is time to remove the working shore from the trench, the pressure inside the horizontal shore cylinders is released by reattaching pump 10, then the fluid returns from the shore via port 35, through valve 74, releasing the pressure and allowing the shore to retract. To accomplish this, exhaust valve 74 located on the top of block 12 is opened to allow the fluid to flow through exhaust tubes 49 and 51 and out exhaust port 110, back into container 11. Pressure gauge 76 is provided on block 12 to constantly measure the pressure in the pump in order to achieve the preselected desired pressure in the shore.

The shore equipment must be inserted in the trench and brought to a specific preselected pressure. Too little pressure or too much pressure both will have a negative effect on maintaining the sides of the trench in a safe condition.

Having thus described the invention, I claim:

1. A multi-stage manual hydraulic pump having a pump handle, adapted to pump fluid to a high pressure, comprising a plurality of cylinders of decreasing volume, each cylinder having a cylinder piston, all of said cylinder pistons mechanically connected together, and mechanically connected to the pump handle, each of the higher volume cylinders having a block containing means to disable each higher volume cylinder in succession as pressure within the pump increases, by preventing the flow of fluid to the cylinder at a designated pressure being reached, the lowest volume cylinder reaching the highest pressure, further comprising two fluid inlet ports, the first port carrying fluid to the low volume, high pressure cylinder and to a set of flow tubes leading to each of the cylinder blocks and the second port carrying fluid to a set of flow tubes leading to each of the higher volume cylinders, said disabling means comprising means to adjustably control the pressure required to disable each of the higher volume cylinders.

2. The pump of claim 1 further comprising check valves in the flow tubes and check valves in each of the higher volume cylinders to control the direction of flow of the fluid.

3. A three-stage manual hydraulic pump having a pump handle, adapted to pump fluid to a high pressure, comprising a high volume cylinder, a medium volume cylinder and a low volume, high pressure cylinder, each cylinder having a cylinder piston, all of said cylinder pistons mechanically connected together, and mechanically connected to the pump handle, the high volume and medium volume cylinders having a block containing means to disable the cylinder at a preset pressure, the lowest volume cylinder reaching the highest pressure, said disabling means comprising a piston adapted to prevent the flow of fluid to the cylinder at the preset pressure being reached, means to adjustably control the pressure required to move the piston, further comprising two fluid inlet ports, the first port carrying fluid to the low volume, high pressure cylinder and to a set of flow tubes leading to each of the cylinder blocks and the second port carrying fluid to a set of flow tubes leading to each of the higher volume cylinders.

4. A multi-stage manual hydraulic pump having a pump handle adapted to pump fluid to a high pressure in trench shoring, comprising a plurality of cylinders of decreasing volume, each cylinder having a cylinder piston, all of said cylinder pistons mechanically connected together, and mechanically connected to the pump handle, each of the higher volume cylinders having a block containing means to disable each higher volume cylinder at succeeding preset higher pressures by preventing the flow of fluid to the cylinder at the designated pressure being reached, the lowest volume cylinder reaching the highest pressure, said disabling means comprising a piston adapted to prevent the flow of fluid to the cylinder at the preset pressure being reached, means to adjustably control the pressure required to move the piston, further comprising two fluid inlet ports, the first port carrying fluid to the low volume, high pressure cylinder and to a set of flow tubes leading to each of the cylinder blocks and the second port carrying fluid to a set of flow tubes leading to each of the higher volume cylinders, means to connect the pump in a container of fluid, means to connect the fluid output of the pump to the shoring.

5. The pump of claim 1, 3, or 4 further comprising check valves in the flow tubes, check valves in higher volume cylinders and check valves in the inlet ports to control the direction of flow of the fluid.

6. The pump of claim 1, 3 or 4 further comprising a pressure gauge to constantly monitor the pressure in the pump.

7. The pump of claims 1, 3, or 4, or further comprising filters located in said inlet ports to filter out unwanted impurities.

8. The pump of claims 1, 3, or 4 in which said means to control the disabling pistons are second pistons operated by air, fluid or a combination thereof.

9. The pump of claims 1, 3, or 4 in which said means to control the disabling pistons are O-rings or seals, operated by air, fluid or a combination thereof.

10. The pump of claims 1, 3, or 4 comprising air or fluid intake valves located on each higher volume block to introduce or remove air, fluid or a combination thereof, to control the pressure at which each of the disabling pistons disables each of the higher volume cylinders.

* * * * *